United States Patent [19]

Koehn et al.

[11] Patent Number: 4,792,042

[45] Date of Patent: Dec. 20, 1988

[54] TRANSPARENT BOX FOR PROTECTING AGAINST DAMAGE FROM ELECTROSTATIC DISCHARGE AND SHEET MATERIAL TO BE CUT INTO A BOX BLANK FOR FORMING SAME

[75] Inventors: Stephen C. Koehn, Round Rock; Ricky A. Plautz, Georgetown, both of Tex.

[73] Assignee: Minnesota Mining and Manufacturing Company, St. Paul, Minn.

[21] Appl. No.: 124,984

[22] Filed: Nov. 24, 1987

[51] Int. Cl.[4] ..... B65D 81/24

[52] U.S. Cl. ..... 206/328; 206/524.3; 220/82 R; 220/417; 428/922; 428/35.8; 428/35.9

[58] Field of Search ..... 206/524.1, 524.2, 524.3, 206/328; 220/82 R, 417, 418; 229/164, 3.5 R, 3.5 MF; 361/220; 428/35, 461, 922

[56] References Cited

U.S. PATENT DOCUMENTS

| | | | |
|---|---|---|---|
| 4,064,206 | 12/1977 | Seufert . | |
| 4,154,344 | 5/1979 | Yenni, Jr. et al. . | |
| 4,156,751 | 5/1979 | Yenni, Jr. et al. . | |
| 4,171,049 | 10/1979 | Nohara et al. | 206/328 |
| 4,179,252 | 12/1979 | Seufert . | |
| 4,348,449 | 9/1982 | Seufert . | |
| 4,477,013 | 10/1984 | Herrin . | |
| 4,528,222 | 7/1985 | Rzepecki et al. | 206/328 |
| 4,553,190 | 11/1985 | Mueller . | |
| 4,593,813 | 6/1986 | Powel | 206/328 |
| 4,647,714 | 3/1987 | Goto | 206/328 |
| 4,662,514 | 5/1987 | Berbeco | 206/328 |
| 4,677,809 | 7/1987 | Long et al. | 206/328 |
| 4,699,830 | 10/1987 | White . | |
| 4,706,438 | 11/1987 | Ohlbach . | |
| 4,707,414 | 11/1987 | Long et al. | 206/328 |
| 4,711,350 | 12/1987 | Yen | 206/324 |
| 4,746,574 | 5/1988 | Hattori et al. | 428/922 |

FOREIGN PATENT DOCUMENTS

| | | | |
|---|---|---|---|
| 2516293 | 5/1983 | France | 206/328 |

*Primary Examiner*—Jimmy G. Foster

*Attorney, Agent, or Firm*—Donald M. Sell; William D. Bauer

[57] ABSTRACT

A transparent box for protecting against damage from electrostatic discharge and sheet material to be cut into a box blank for forming the same. The box blank has an electrically insulating, transparent, polymeric sheet and a continuous, transparent, electrically conductive layer disposed on at least one surface of the polymeric sheet. The polymeric sheet has grooves on at least one surface forming fold lines and the sheet material has sufficient stiffness to enable the sheet material when cut into a box blank and folded into a box to hold its shape. Grooves formed into the surface of polymeric sheet 14 and the subsequent folding do not disturb the continuous electrically conductive layer enabling the completed box to have complete electrostatic shielding from all directions.

25 Claims, 4 Drawing Sheets

TRANSPARENT BOX FOR PROTECTING AGAINST DAMAGE FROM ELECTROSTATIC DISCHARGE AND SHEET MATERIAL TO BE CUT INTO A BOX BLANK FOR FORMING SAME

BACKGROUND OF THE INVENTION

The present invention relates to packaging for protecting electronic components or assemblies from potentially damaging electrostatic discharges during shipment and storage.

Each of U.S. Pat. Nos. 4,154,344 and 4,156,751, both Yenni, Jr., et al, (both of which are hereby incorporated by reference) after discussing prior envelopes for protecting electronic components, discloses a material for such envelopes that provides better protection from electrostatic discharges while still permitting the envelope to be transparent. The Yenni, Jr., et al material comprises a electrically insulating, polymeric sheet having first and second major surfaces with the first major surface being exterior of the second major surface. On the inner surface of the envelope, an antistat provides a surface resistivity in the range of $10^8$ to $10^{14}$ ohms per square, and exterior of the electrically insulating polyermic sheet, an electrically conductive layer provides a surface resistivity of no greater than about $10^4$ ohms per square. When the conductive layer is of metal, it preferably is covered by a layer of abrasion resistant material which can be quite thin. Preferably, the envelope is formed by folding a single sheet and sealing its edges to ensure electrical continuity of both the antitatic and electricaly conductive layers. The polymeric sheet should have sufficiently high impedance, e.g.,$10^{15}$ ohms-cm, to prevent the direct coupling of external electrostatic charges to the contents of the envelope.

While the container of each of the Yenni, Jr., et al patents does not hold a shape, that of U.S. Pat. No. 4,553,190, Mueller (which is hereby incorporated by reference) does. The layering of the wall of a preferred Mueller container is similar to that of a preferred Yenni, Jr., et al envelope except that its electrically insulating polymeric sheet is sufficiently thick to form a shape-retaining tube. The inner surface of Mueller's transparent wall may have an antistatic layer to help prevent electroststic charge buildup on the packaged electronic components such as could be caused by triboelectric charging, preferably one providing a surface resistivity of from $10^7$ to $10^{14}$ ohms per square. The Mueller material also has an electrically conductive layer which provides a surface resistivity of not more than $10^6$ ohms per square. The electrically conductive layer preferably is metal which may be applied by sputtering or vapor coating nickel, aluminum or indium tin oxide to a thickness of approximately 50 to 500 Angstroms (5 to 50 nanometers), preferably covered by a transparent protective layer as in the Yenni patents. Most figures of the Mueller drawing show an A-shape container with two open ends. A plug across each of the open ends provides a protective spacing between the contents and any external electrostatic discharges and also keeps the contents from falling out.

It has been suggested that a transparent box can be made from a box blank of a thermoplastic resin sheet which has been formed with flexible fold lines. See U.S. Pat. Nos. 4,064,206; 4,179,252; and 4,348,449 (all Seufert), the later two being divisions of the first. Seufert creates the scores or fold lines by pressing the sheet with a forming tool to a depth of at least 25% of the thickness of the sheet while maintaining a temperature between the softening temperature and the melting temperature of the thermoplastic sheet. The example of each of the Seufert patents employed "a highly transparent, plasticizer-free hard PVC material having a high impact resistance and K-value of 60". This was scored to 70% of its thickness of 0.25 millimeters and formed into box blanks that 'had perfectly bendable edges and could be processed without difficulty first to flat folded boxes and then to unfolded boxes which were packed and closed on cardboard machines at a rate of approximately 180 pieces per minute.

SUMMARY OF THE INVENTION

The present invention provides an economical, transparent package and sheet material for forming such package for delicate electronic components that is believed to provide better protection from potentially damaging electrostatic discharges than does any transparent package of the prior art. More specifically, the invention provides a transparent box blank comprising an electrically insulating polymeric sheet, or which at least one face bears a continuous, transparent electrically conductive layer and a first surface is scored to provide fold lines to permit the box blank to be folded to form a transparent box with a continuous electrically conductive layer. The polymeric sheet has sufficient stiffness that the box holds its shape when placed at the bottom of a stack of a large number of identical boxes.

The transparent box blank of the invention preferably is formed from a material similar to that preferred in the Mueller patent. That is, the polymeric sheet should be strong, tough and dimensionally stable, e.g., polyvinyl chloride film which, at a thickness of from about 0.25 millimeters to 3 millimeters, should have adequate stiffness to permit the novel boxes to be stacked. Stacking enables a large number of the boxes, each containing one or more electronic components, to be packed into a shipping carton which is resistent to the rough handling typical of mailing and freight handling. Because the box holds its shape, electronic components such as microchips and printed circuit boards can be cradled within the boxes to be isolated from physical shocks such as the dropping of a single box or a carton of the boxes onto the floor. Such cradling also permits the contents of the box to be spaced from its walls, thus, providing much greater protection from electrical fields as compared to flexible envelopes.

The polymeric sheet preferably bears an antistat which is coextensive with its first surface. As disclosed in the Yenni, Jr., et al and Mueller patents, antistat may either be incorporated into the polymeric sheet or applied as a separate layer covering the first surface of the sheet material. As preferred in the Mueller patent, the antistat should provide a resistivity in the range of $10^6$ to $10^{14}$ ohms per square, and the electrically conductive layer should provide a surface resistivity of no greater than $10^4$ ohms per square. Also like the preferred material for the Mueller tube, the electrically conductive layer preferably is a metal which may be applied by sputtering or preferably by vapor coating to a thickness in the range of 5 to 50 nm, and the conductive layer preferably is protected by a continuous transparent film or resin which affords good resistance to abrasion.

The scores in the surface of the sheet material preferably are so formed to provide a radius of curvature of the conductive layer of no less than 0.3 millimeters when the sheet material minimizing any danger of cracking the electrically conductive layer upon forming the sheet material into a box.

BRIEF DESCRIPTION OF THE DRAWINGS

The foregoing advantages, construction and operation of the present invention can be more readily understood by reference to the following Figures in which.

DETAILED DESCRIPTION OF THE PREFERRED EMBODIMENTS

Figure 1:
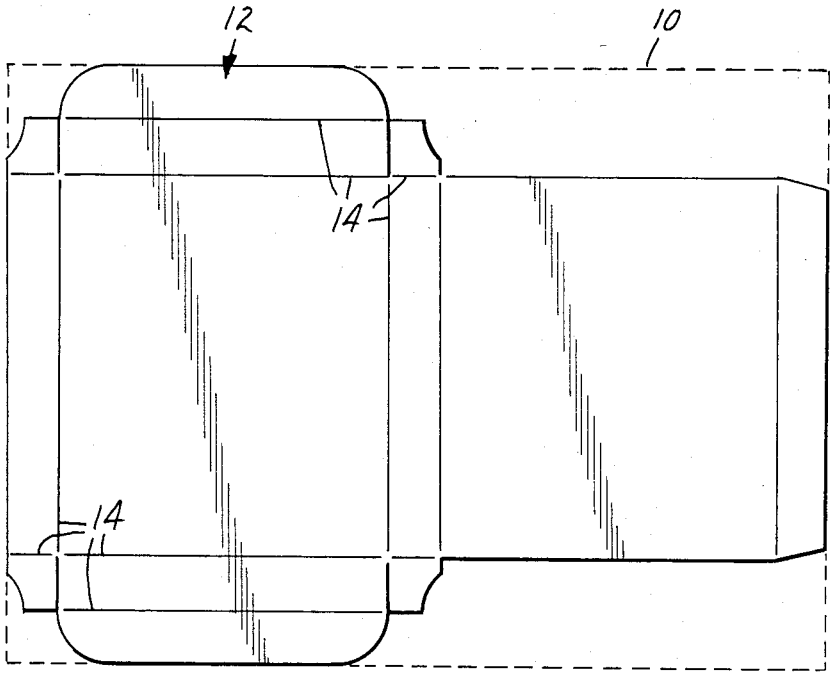
FIG. 1 illustrates sheet material of the present invention cut into a box blank.
Figure 2:
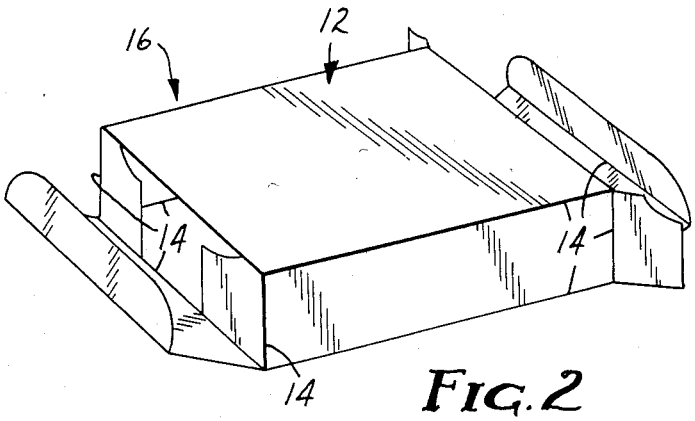
FIG. 2 illustrates the box blank of FIG. 1 being folded into a box.

FIG. 1 illustrates the sheet material 10 of the present invention which has been cut into the shape of a box blank 12 having fold lines 14 along which the box blank 12 when folded forms the completed box of the present invention. FIGS. 2 shows the box blank 12 of FIG. 1 being folded along fold lines 14 forming the box 16 of the present invention. The sheet material 12 when folded to form box 16 is sufficiently rigid or has sufficient stiffness to enable the box 16 to hold its shape. Thus, formed box 16 may be utilized to hold electrostatic sensitive electronic components or printed circuit boards containing such electrostatic sensitive electronic components and protect them against electrostatic discharge and also protect them mechanically from mechanical damage. Further, a plurality of boxes 16 may be stacked one on top of the other in an orderly arrangement and the sheet material 12 of the box 16 will be sufficiently rigid so that the lower box or boxes 16 will not collapse.

Figure 3:
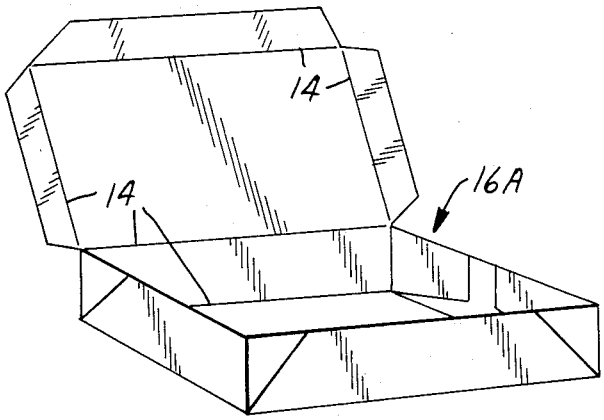
FIG. 3 illustrates an alternative embodiment of a folded box of the present invention.

FIG. 3 illustrates an alternative embodiment box 16A having been folded from a box blank 12 along fold lines 14.

Figure 4:
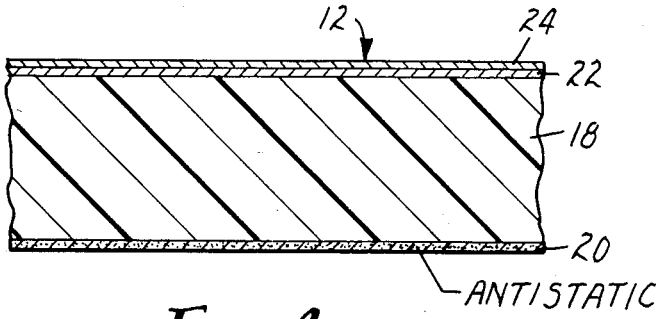
FIG. 4 is a cross-section of the preferred embodiment of the sheet material of the present invention.

The preferred sheet material 12 of the present invention is illustrated in a cross-sectional view in FIG. 4. Sheet material 12 comprises a transparent electrically insulating polymeric sheet 18 which is sufficiently thick to give the sheet material 12 sufficient stiffness or rigidity to enable the box 16 to hold its shape. Polymeric sheet 18 may be constructed from a number of materials such as polyvinyl chloride, PETG, ABS, PET OR polypropylene. In order to be electrically insulated, it is preferred that the polymeric sheet 18 have a volume resistivity of at least $10^{12}$ ohms-centimeter. Along the surface of the sheet material 12 which will ultimately form the interior of box 16 is an antistatic layer 20. Antistatic layer 20 may be formed from a separate layer of any of a number of commonly known antistatic materials or may actually be surfactant or lubricant which is volume loaded into or coated onto polymeric sheet 18 which creates a surface resistivity on polymeric sheet 18 which is antistatic, thus, forming antistatic layer 20 by surface effect. It is preferred that antistatic layer 20 have a surface resistivity of from $10^6$ to $10^{14}$ ohms per square and a number of commonly available antistatic materials may be utilized for antistatic layer 20 including those identified in the Yenni, Jr., et al patents and the Mueller patent which have already been incorporated by reference. A preferred antistatic agent is Staticide antistat avilable from ACL, Inc., of Elk Grove Village, Ill. which is topically coated on polymeric sheet 18. On one surface of the polymeric sheet 18, preferably the surface of polymeric sheet 18 which will be more exterior of the completed box 16 is a transparent electrically conductive layer 22. It is preferred that transparent electrically conductive layer 22 be formed from a thin coat of metal which will give the desired electrical conductivity but will be sufficiently thin to retain transparency. For purposes of this discussion each of the layers of sheet material 12 are considered to be transparent when the overall sheet material 12 has an overall transmissability of visable light of about 40% or greater. For purposes of this invention, electrically conductive layer 22 should have a surface resistivity of not more than $10^4$ ohms per square. Any number of known metals may be disposed on the surface of polymeric sheet 18 to form electrically conductive layer 22 by commonly known vapor coating, or sputtering technics. The preferred material for electrically conductive layer 22 is a thin layer of nickel. Other metals which could be utilized for electrically conductive layer 22 would include aluminum, indium tin oxide, platinum, silver, gold or iron. With the thin electrically conductive layer 22 disposed towards the exterior box 16. It is preferably that an abrasion resistant layer 24 be applied to electrically conductive layer 22. Such abrasion resistant layer 24 could be a thin, 0.15 micrometers, or an abrasion resistant material such as that disclosed in the Yenni, Jr., et al patents. An example of a material which could be applied to form abrasion resistant layer 24 is photocurable acrylic material.

Figure 5:
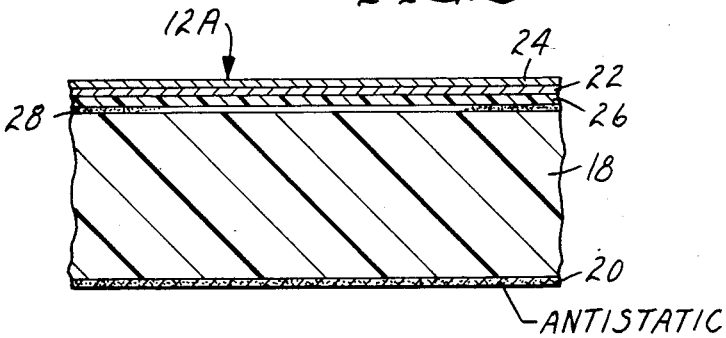
FIGS. 5 through 12 are cross-sectional views of alternative embodiments of the sheet material of the present invention.

FIG. 5 illustrates a cross-sectional view of an alternative embodiment of sheet material 12A. Sheet material 12A is similar to the sheet material 12 in FIG. 4 in that it has the same polymeric sheet 18 and the antistatic layer 20 which will be disposed on the surface of polymeric sheet 18 which will ultimately be the interior of box 16. Sheet material 12A also has an electrically conductive layer 22 and may optionally have protective overcoat layer 24. In the sheet material 12A, however, the electrically conductive layer 22 is deposited not directly onto polymeric sheet 18 but onto another transparent polymeric sheet, which may be flexible since the rigidity of sheet material 12A is being supplied by polymeric sheet 18, 26 which is bonded by adhesive 28 to polymeric sheet 18. An example of material which could be utilized for polymeric sheet 26 would be a sheet of polyethylene terephthalate. Any suitable adhesive such as acrylic could be utilized for adhesive 28.

Figure 6:
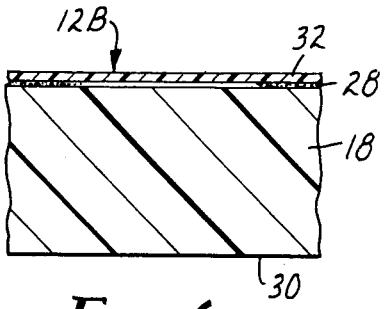

FIG. 6 illustrates a cross-sectional view of an alternative embodiment of sheet material 12B. Sheet material 12B again has a transparent, electrically insulating, polymeric sheet 18. Polymeric sheet 18 has been volume loaded with a commercially available antistat such as is disclosed in Mueller to provide an antistatic surface on surface 30 of polymeric sheet 18. The electrically conductive layer 22 on sheet material 12B is provided by a layer of static shielding film 32 such as is disclosed in the Yenni, Jr., et al patents, which have already been incorporated herein by reference, which is bonded to polymeric sheet 18 by adhesive 28.

Figure 7:
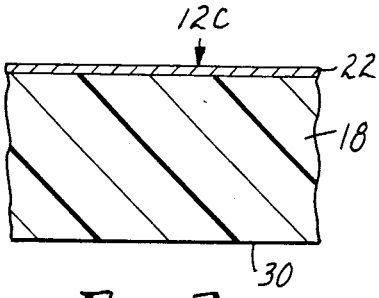

FIG. 7 illustrates a cross-sectional view of another alternative embodiment for sheet material 12C. Sheet material 12C also has a transparent, electric insulating, polymeric sheet 18 as in FIG. 6 and is also volume loaded with a commercially available antistat to provide an antistatic surface on surface 30 as in FIG. 6. Instead of utilizing the static shielding film 32, the sheet material 12C is provided with electrically conductive surface 22 which is a metal, preferably nickel, deposited directly onto polymeric sheet 18.

Figure 8:
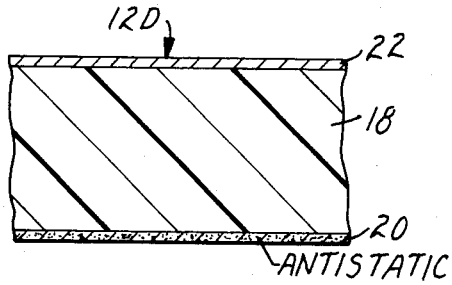

FIG. 8 illustrates a cross-sectional view of another alternative embodiment of sheet material 12D. Sheet material 12D again has a transparent, electrically insulating, polymeric sheet 18. An antistatic layer 20 has been added to the surface of polymeric sheet 18 which will ultimately form the interior of box 16. The opposite surface of polymeric sheet 18 has been coated with an electrically conductive layer 22. Thus, sheet material 12D is similar to the sheet material 12 illustrated in FIG. 4 but without abrasion resistant layer 24.

Figure 9:
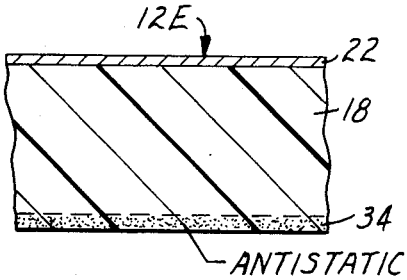

FIG. 9 illustrates an alternative embodiment of the sheet material 12E of the present invention. Sheet material 12E also has a transparent, electrically insulating, polymeric sheet 18. Polymeric sheet 18 has grafted onto the surface, which will ultimately become the interior of box 16, a grafted antistat 34 to provide the antistatic surface on the interior of box 16. The opposite surface of polymeric sheet 18 is coated with electrically conductive layer 22 as in FIGS. 7 and 8.

Figure 10:
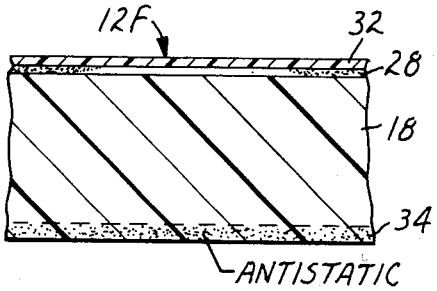

FIG. 10 illustrates a cross-sectional view of an alternative embodiment of sheet material 12F. Sheet material 12F again has an electrically insulating, transparent, polymeric sheet 18 as in the other sheet material alternatives. Sheet material 12F has a grafted antistat 34 as shown in FIG. 9. Sheet material 12F utilizes a static shielding film 32 which is bonded to polymeric sheet 18 by adhesive 28 as is described in FIG. 6.

Figure 11:
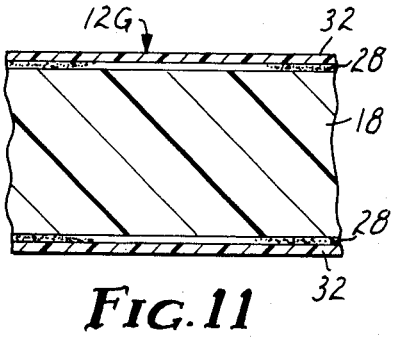

FIG. 11 illustrates an alternative embodiment of sheet material 12G of the present invention. Sheet material 12G also has an electrically insulating transparent polymeric sheet 18. Sheet material 12G has static shielding film 32 bonded to both major surfaces by adhesive 28, thus, providing an electrically conductive layer both interior of and exterior of polymeric sheet 18. With the preferred static shielding film 32 as disclosed in the Yenni, Jr.,et al patents, the interior of box 16 will, perhaps, be more conductive than a normally antistatic material. The static shielding film 32 as described in the Yenni, Jr., et al patents, however, could be modified by applying a thicker overcoat or by adhesively applying the static shielding film 32 with the metallic surface nearest polymeric sheet 18 to provide the antistatic surface on the surface of sheet material 12G which will become the interior of box 16.

Figure 12:
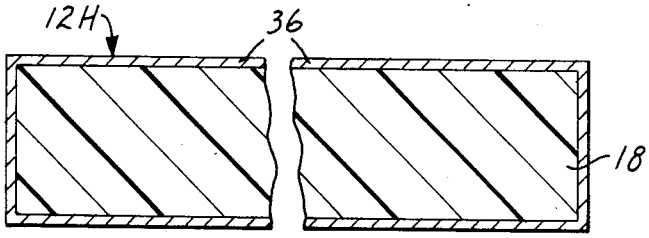

FIG. 12 illustrates an alternative embodiment of the sheet material 12H of the present invention. Sheet material 12H also has an electrically insulating, transparent, polymeric sheet 18. Polymeric sheet 18 has been coated on all sides within a copper sulfide plating bath which deposits a thin layer of copper sulfide 36 on all surfaces of polymeric sheet 18. A protective overcoat (not shown) could be added over copper sulfide 36.

Figure 13:
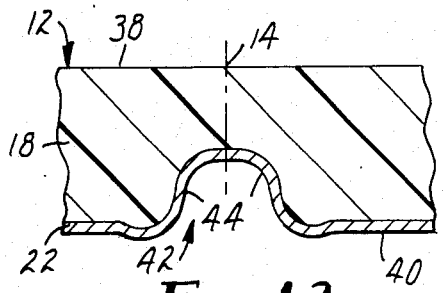
FIG. 13 is a cross-sectional view illustrating the preferred embodiment of a grooved sheet material prior to folding.
Figure 14:
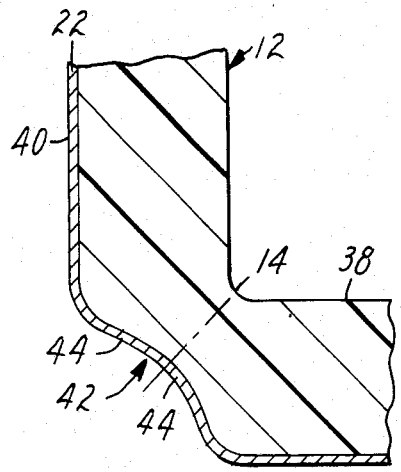
FIG. 14 is a cross-sectional view illustrating the preferred embodiment of a grooved sheet material following folding.

FIGS. 13 and 14 illustrates sheet material 12 of the present invention which is intended to be folded along fold line 14 with surface 38 forming the interior of box 16. Surface 40 of sheet material 12 is formed with a groove 42 along fold line 14 to provide a groove 42 having walls 44 and a thickness of sheet material 12 at fold line 14 which is thinner than the thickness of sheet material 12 at other locations. Groove 42 is formed with a platen under heat and pressure so that electrically conductive layer 22 is deformed but not made discontinuous, that is, after groove 42 is formed at sheet material 12, electrically conductive layer 22 should still be continuous over the entire surface of sheet material 12. Once the sheet material 12 has been formed with groove 42, it is folded as illustrated in FIG. 14 so that the surface 38 of sheet material 12 is formed into a 90 degree angle. Thus, formed the walls 44 of groove 42 flatten and allow electrically conductive layer 22 to still be continuous over the entire surface of sheet material 12.

Figure 15:
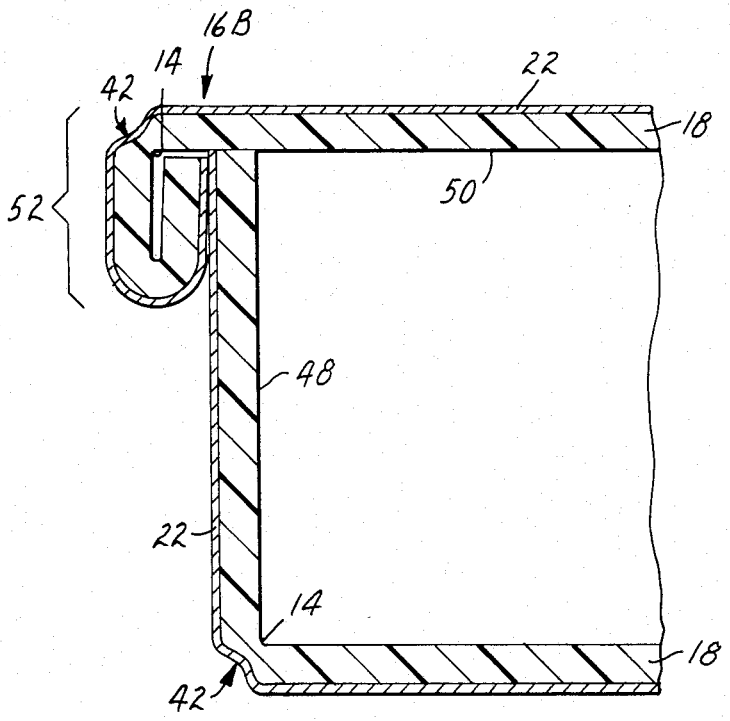
FIG. 15 is a cross-sectional view illustrating an alternative embodiment of the box of the present invention having a "shoe box" lid.

FIG. 15 illustrates an alternative box 16B. Box 16B is formed from a first piece 48 and a second piece 50 of the sheet material 12 of the present invention. Both first piece 48 and second piece 50 have an electrically conductive layer 22 on their exterior surfaces, that is, exterior to box 16B. First piece 48 of sheet material 12 is folded along fold line 14 to form the bottom portion of box 16B (only a section of which is illustrated in FIG. 15). Thus, formed first piece 48 forms a box 16B but with a open top. Second piece 50 is folded along fold line 14 to form a lid having edges formed with a portion of second piece 50 which is folded back onto itself making electrically conductive layer 22 present not only on the exterior top of lid which is formed from second piece 50 but also on both faces of edge 52 so that when the lid formed from second piece 50 is placed over first piece 48 completing box 16B the conductive layers 22 of both first piece 48 and second piece 50 will contact each other allowing box 16B to have a continuous electrically conductive exterior surface.

Thus, it can be seen that there has been shown and described a novel transparent box for protecting against damage from electrostatic discharge and a sheet material to be cut into a box blank for forming the same. It is to be recognized and understood that various changes, modifications and substitution in the form and the details of the present invention can be made by those skilled in the art without departing from the scope of the following claims:

What is claimed is:

1. A sheet material adapted to be cut into a box blank adapted to be formed into a box to protect electronic components from electrostatic discharge by folding said box bank along fold lines in said box blank, comprising:
   - an electrically insulating, transparent, polymeric sheet;
   - a continuous, transparent, electrically conductive layer disposed on at least one surface of said polymeric sheet;
   - said polymeric sheet having grooves on a first surface of said box blank forming said fold lines;
   - said sheet material, when cut into said box blank and folded into said box, having sufficient stiffness to enable said box to hold its shape.

2. A sheet material as in claim 1 which is formed with at least one flap which folds over to seal said box and can be unfolded to permit said box to be reused.

3. A sheet material as in claim 1 wherein said grooves do not completely penetrate said polymeric sheet and do not interrupt said electrically conductive layer.

4. A sheet material as in claim 3 wherein said grooves are formed so as to provie a radius of curvature in said conductive layer of not less than 0.3 millimeters.

5. A sheet material as in claim 4 wherein said grooves have sloping walls.

6. A sheet material as in claim 3 wherein said polymeric sheet has a volume resistivity of at least $10^{12}$ ohms-cm.

7. A sheet material as in claim 6 wherein said conductive layer has a surface resistivity of not more than $10^4$ ohms per square.

8. A sheet material as in claim 7 wherein said sheet material further comprises an antistatic surface on the surface of said box blank which is to be the interior surface of said box.

9. A sheet material as in claim 8 wherein said sheet material has a surface resistivity on said antistatic surface of at least $10^6$ ohms per square and not more than $10^{14}$ ohms per square.

10. A sheet material as in claim 3 wherein said electrically conductive layer is disposed on said first surface of said box blank.

11. A sheet material as in claim 10 which further comprises a continuous, transparent, electrically conductive layer disposed on the surface of said polymeric sheet opposite said first surface.

12. A sheet material as in claim 1 wherein said grooves are formed by scoring.

13. A box for protecting electronic components from electrostatic discharge, formed from a box blank comprising:

an electrically insulating, transparent, polymeric sheet;

a continuous, transparent, electrically conductive layer disposed on at least one surface of polymeric sheet;

said polymeric sheet having grooves on first surface of said box blank forming said fold lines;

said box blank, when folded into said box, having sufficient stiffness to enable said box to hold its shape.

14. A box as in claim 13 which is formed with at least one flap which folds over to seal said box and can be unfolded to permit said box to be reused.

15. A box as in claim 13 wherein said grooves do not completely penetrate said polymeric sheet and do not interrupt said electrically conductive layer.

16. A box as in claim 15 wherein said grooves are formed so as to provide a radius of curvature in said conductive layer of not less than 0.3 millimeters when said box blank is folded 90 degrees.

17. A box as in claim 16 wherein said grooves have sloping walls.

18. A box as in claim 15 wherein said polymeric sheet has a volume resistivity of at least $10^{12}$ ohms-cm.

19. A box as in claim 18 wherein said conductive layer has a surface resistivity of not more than $10^4$ ohms per square.

20. A box as in claim 19 wherein said box blank further comprises an antistatic surface on the surface of said box blank which is the interior surface of said box.

21. A box as in claim 20 wherein said box blank has a surface resistivity on said antistatic surface of at least $10^6$ ohms per square and not more than $10^{14}$ ohms per square.

22. A box as in claim 15 wherein said electrically conductive layer is disposed on said first surface of said box blank.

23. A box as in claim 22 which further comprises a continuous, transparent, electrically condutive layer disposed on the surface of said polymeric sheet opposite said first surface.

24. A box as in claim 16 wherein said grooves are formed by scoring.

25. A box for protecting electronic components from electrostatic discharge, formed from a first and a second box blank, each of said first and said second box blank comprising:

an electrically insulating, transparent, polymeric sheet;

a continuous, transparent, electrically conductive layer disposed on a first surface of said polymeric sheet;

said polymeric sheet having grooves on one surface of said box blank forming fold lines along which said box blanks are folded to form said box;

said first box blank being formed into a container having an open top, said first box blank being folded with said first surface of said polymeric sheet being exterior of said box;

said second box blank being formed into a lid which can cover said open top of said container and having edges securing said lid to said container, said second box blank being folded with said first surface of said polymeric sheet being exterior of said box, said edges of said lid being formed with said second box blank being folded back on itself making said electrically conductive layer present on the interior surface of said edges.

* * * * *

UNITED STATES PATENT AND TRADEMARK OFFICE

CERTIFICATE OF CORRECTION

PATENT NO. : 4,792,042

DATED : December 20, 1988

INVENTOR(S) : Stephen C. Koehn and Ricky A. Plautz

It is certified that error appears in the above-identified patent and that said Letters Patent is hereby corrected as shown below:

Col. 1, line 31, "antitatic" should read --antistatic--.

Col. 1, line 32, "electricaly" should read --electrically--.

Col. 1, line 45, "electroststic" should read --electrostatic--.

Col. 2, line 22, "or" should read --of--.

Col. 4, line 39, "or" should read --of--.

Col. 7, line 5, "provie" should read --prove--.

Col. 8, line 21, "condutive" should read --conductive--.

Signed and Sealed this

Eleventh Day of July, 1989

*Attest:*

*Attesting Officer*

DONALD J. QUIGG

*Commissioner of Patents and Trademarks*